US007846006B2

(12) United States Patent
Stinson et al.

(10) Patent No.: US 7,846,006 B2
(45) Date of Patent: Dec. 7, 2010

(54) DRESSING A WAFER POLISHING PAD

(75) Inventors: Mark G. Stinson, Wood River, IL (US); Madhavan S. Esayanur, St. Peters, MO (US); Dennis Buese, O'Fallon, MO (US); Emanuele Corsi, Novara (IT); Ezio Bovio, Bellinzago Novarese (IT); Antonio Maria Rinaldi, Novara (IT); Larry Flannery, Warrenton, MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 579 days.

(21) Appl. No.: 11/771,495

(22) Filed: Jun. 29, 2007

(65) Prior Publication Data

US 2008/0009231 A1 Jan. 10, 2008

Related U.S. Application Data

(60) Provisional application No. 60/806,384, filed on Jun. 30, 2006.

(51) Int. Cl.
*B24B 49/00* (2006.01)
*B24B 51/00* (2006.01)

(52) U.S. Cl. ..... 451/5; 451/10; 451/21; 451/56

(58) Field of Classification Search ..... 451/21, 451/56, 72, 443, 444, 5, 10
See application file for complete search history.

(56) References Cited

U.S. PATENT DOCUMENTS

| | | | | |
|---|---|---|---|---|
| 5,664,987 | A * | 9/1997 | Renteln | 451/21 |
| 5,690,544 | A | 11/1997 | Sakurai | |
| 5,961,377 | A | 10/1999 | Jeong | |
| 6,113,462 | A * | 9/2000 | Yang | 451/5 |
| 6,302,762 | B1 | 10/2001 | Inaba et al. | |
| 6,309,277 | B1 | 10/2001 | Arcayan et al. | |
| 6,371,836 | B1 | 4/2002 | Brown et al. | |
| 6,607,423 | B1 * | 8/2003 | Arcayan et al. | 451/8 |
| 6,875,086 | B2 | 4/2005 | Golzarian et al. | |
| 6,896,583 | B2 | 5/2005 | Rodriquez et al. | |
| 6,910,947 | B2 * | 6/2005 | Paik | 451/21 |
| 6,939,208 | B2 | 9/2005 | Kamimura et al. | |
| 6,976,907 | B2 | 12/2005 | Golzarian et al. | |
| 7,033,253 | B2 | 4/2006 | Dunn | |
| 2003/0190873 | A1 | 10/2003 | Wang et al. | |
| 2004/0023602 | A1 * | 2/2004 | Moloney et al. | 451/56 |
| 2005/0164613 | A1 | 7/2005 | Seike et al. | |

* cited by examiner

*Primary Examiner*—Timothy V Eley
(74) *Attorney, Agent, or Firm*—Armstrong Teasdale LLP

(57) ABSTRACT

A dressing apparatus for dressing a polishing pad includes a dressing member engageable with the polishing pad. The dressing apparatus is adapted to change the amount of force exerted by the dressing member on the polishing pad as the dressing member moves radially along the polishing pad. A controller for controlling the dressing apparatus has pre-programmed recipes that are selectable based on the radial profile of a measured polished wafer.

12 Claims, 14 Drawing Sheets

DRESSING A WAFER POLISHING PAD

CROSS-REFERENCE TO RELATED APPLICATION

The present application claims priority to U.S. Provisional Application No. 60/806,384, filed Jun. 30, 2006, the entirety of which is herein incorporated by reference.

FIELD OF THE INVENTION

The present invention relates generally to an apparatus for dressing a polishing pad used to polish semiconductor wafers and a method for dressing.

BACKGROUND OF THE INVENTION

A semiconductor wafer is polished to achieve a flat surface required for the fabrication of today's advanced semiconductor devices. One way to effectively polish a semiconductor wafer involves a chemical mechanical polish system. The polishing system typically includes a silicon carbide block (SiC) for mounting a wafer thereon and a polishing pad. Both the SiC block and the polishing pad are rotatable. As the SiC block and the polishing pad are rotating, the wafer, which is adhered to the block, is pressed against the polishing pad. A solution of Silica and KOH is added onto the surface of the polishing pad. The friction created between the polishing pad and the wafer, along with the applied solution, smoothes the etched surface of the wafer.

Important characteristics in a polished wafer are thickness uniformity, smoothness and flatness of the wafer surface. However, polishing pads degrade over time and thereby produce wafers of lesser quality. Production of wafers with non-uniform surfaces is sometimes due to the surface of the polishing pad being rough, especially when the pad has been used a number of times. Thus, during the life of the polishing pad, it has become necessary to dress the polishing surface of the pad so that the wafers produced using the pad are more uniform, flat and smooth. One way to dress a polishing pad is by smoothing the polishing surface of the pad using an abrasive dressing element.

One example of an apparatus and method of dressing a polishing pad is disclosed in U.S. Pat. No. 6,976,907. The apparatus includes a cylindrical dressing member (i.e., conditioning piece) that is rotatable about an axis of rotation that is generally parallel to the polishing surface. A polishing pad surface metrology system is used to address particular non-uniformity on the polishing surface of the polishing pad and provide a uniform polishing pad surface. In other words, the polishing pad surface is analyzed to determine where and how the surface should be dressed.

SUMMARY OF THE INVENTION

In one embodiment, a system for polishing a semiconductor wafer generally comprises a polishing apparatus including a rotatable polishing pad for polishing the wafer, and a wafer measurement device for obtaining a radial profile of a polished wafer. A dressing apparatus for dressing the polishing pad includes a dressing member engageable with the polishing pad. The dressing apparatus is adapted to change the amount of force exerted by the dressing member on the polishing pad as the dressing member moves radially along the polishing pad. A controller for controlling the dressing apparatus has pre-programmed recipes that are selectable based on the radial profile of a measured polished wafer.

In another embodiment, a dressing apparatus for dressing a polishing surface of a polishing pad for a semiconductor wafer pad generally comprises a rotatable dressing member having a dressing surface for engagement with the polishing surface of the polishing pad. A mounting system mounts the dressing member and is adapted to move the dressing member radially along the polishing surface of the polishing pad, to rotate said dressing member about an axis generally perpendicular to the polishing surface, and to impart a first selective amount of force on the dressing head so that the dressing member applies a second selective amount of force on the polishing surface. The mounting system is adapted to change the first amount of force to thereby change the second amount of force applied on the polishing surface as the dressing member moves radially along the polishing surface.

In yet another embodiment, a method of dressing a polishing surface of a polishing pad used in polishing of wafers generally comprises obtaining a radial profile of a wafer polished with the polishing pad; categorizing the polished wafer into a profile category based on the radial profile of the wafer; selecting a recipe corresponding to the selected category; and dressing the polishing surface of the pad according to the selected recipe using a dressing apparatus.

DETAILED DESCRIPTION OF THE DRAWINGS

Figure 1:
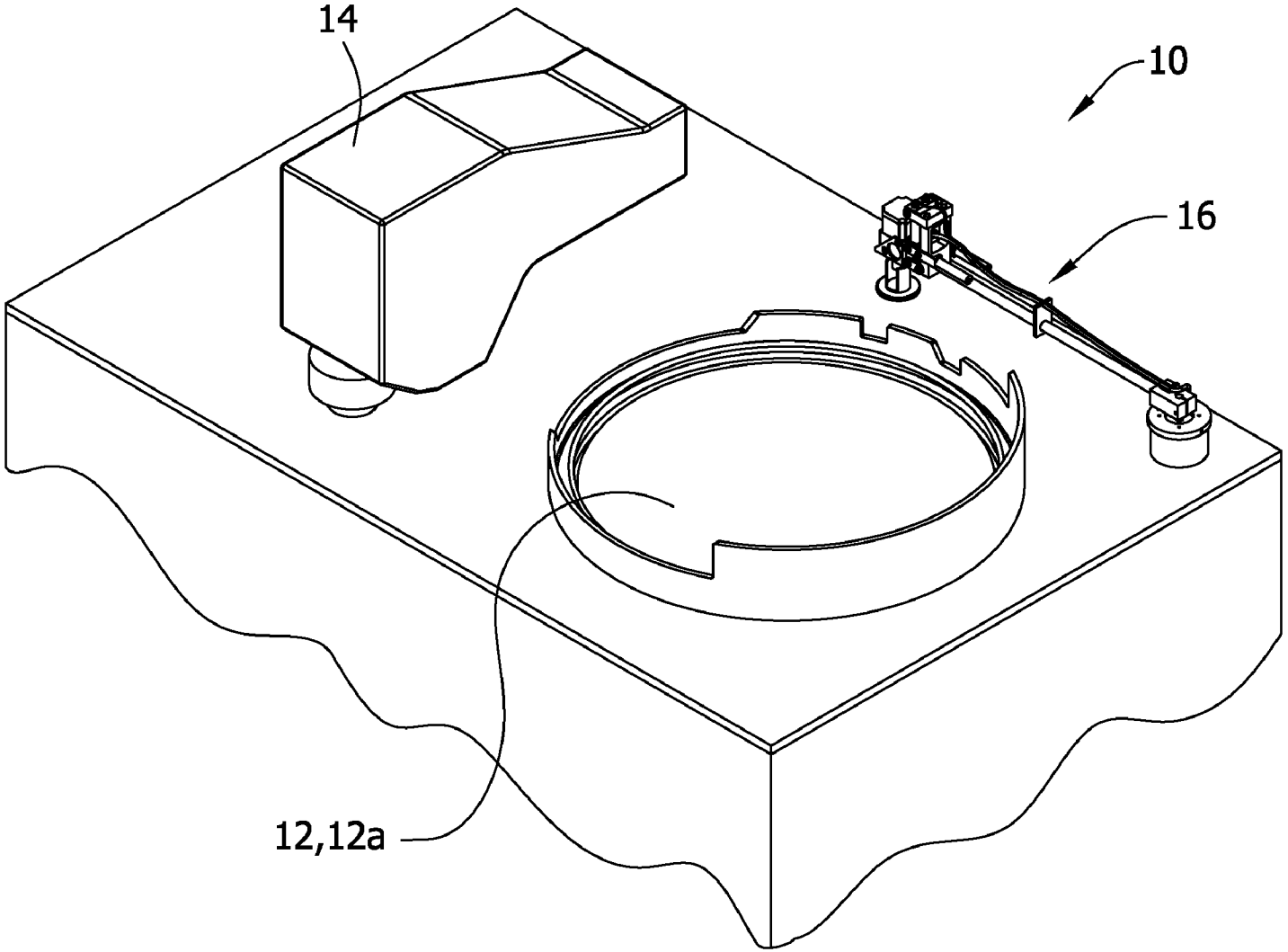
FIG. 1 is a perspective of one embodiment of a wafer polishing system.
Figure 4:
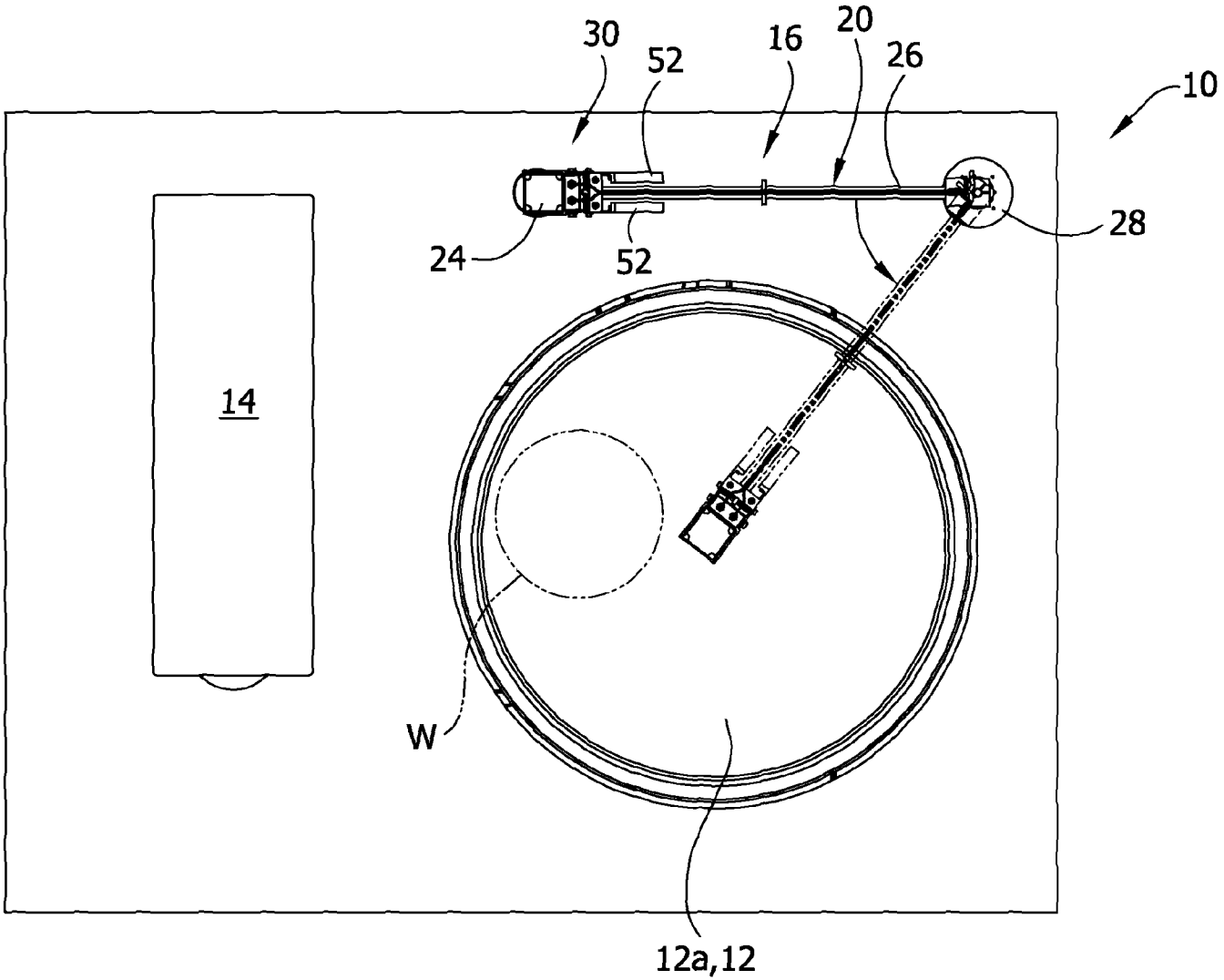
FIG. 4 is a top plan view of the wafer polishing system of FIG. 1.

Referring now to the drawings, and in particular to FIGS. 1 and 4, one embodiment of a wafer polishing system constructed according to the principles of the present invention is generally indicated at 10. The wafer polishing system includes a polishing pad 12 mounted on a rotatable base (not shown) and a wafer mounting device 14 having a rotatable head (removed for clarity) on which a semiconductor wafer (FIG. 4) is mounted. The wafer mounting device 14 is adapted to bring the wafer mounted thereon into contact with the polishing pad 12 as both the wafer and the polishing pad are being rotated. The polishing pad 12, through abrasion and other chemicals which may be added onto the surface of the polishing pad, polishes the surface of the wafer. As is known in the art, a polishing surface 12*a* of the polishing pad 12 may become worn or otherwise roughened during continued use, which can affect the quality of the polished surface of the wafer. A dressing apparatus, generally indicated at 16, of the wafer polishing system 12 is constructed for dressing (i.e., abrading and compressing) the polishing surface 12*a* of the polishing pad 12 to ensure that the polishing pad shapes the wafers to have a generally uniform thickness and a smooth polished surface. It is contemplated within the scope of the invention that the system or apparatus may differ in construction than that shown in the drawings.

Figure 2:
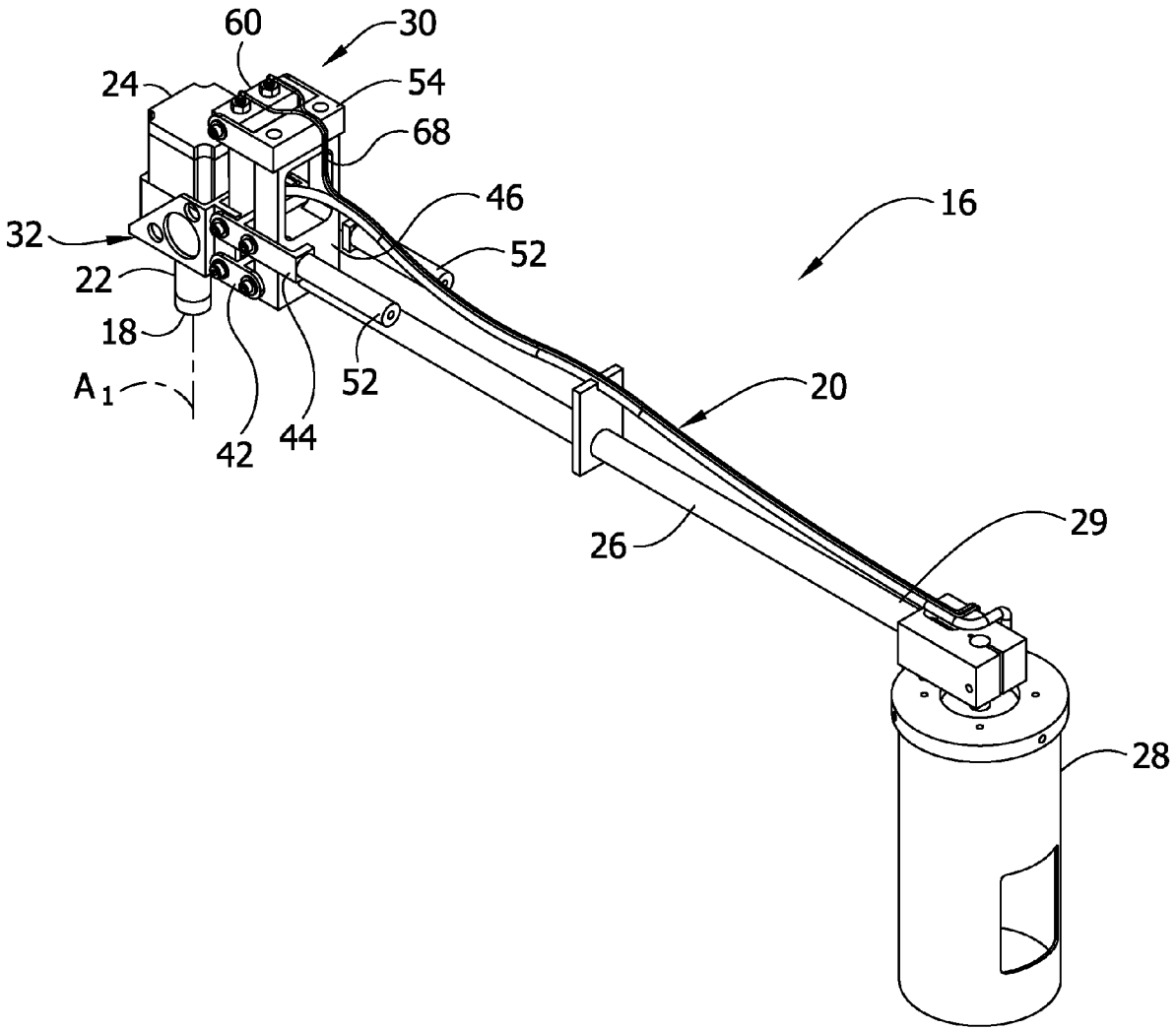
FIG. 2 is a perspective of a dressing apparatus of the polishing system of FIG. 1.
Figure 3:
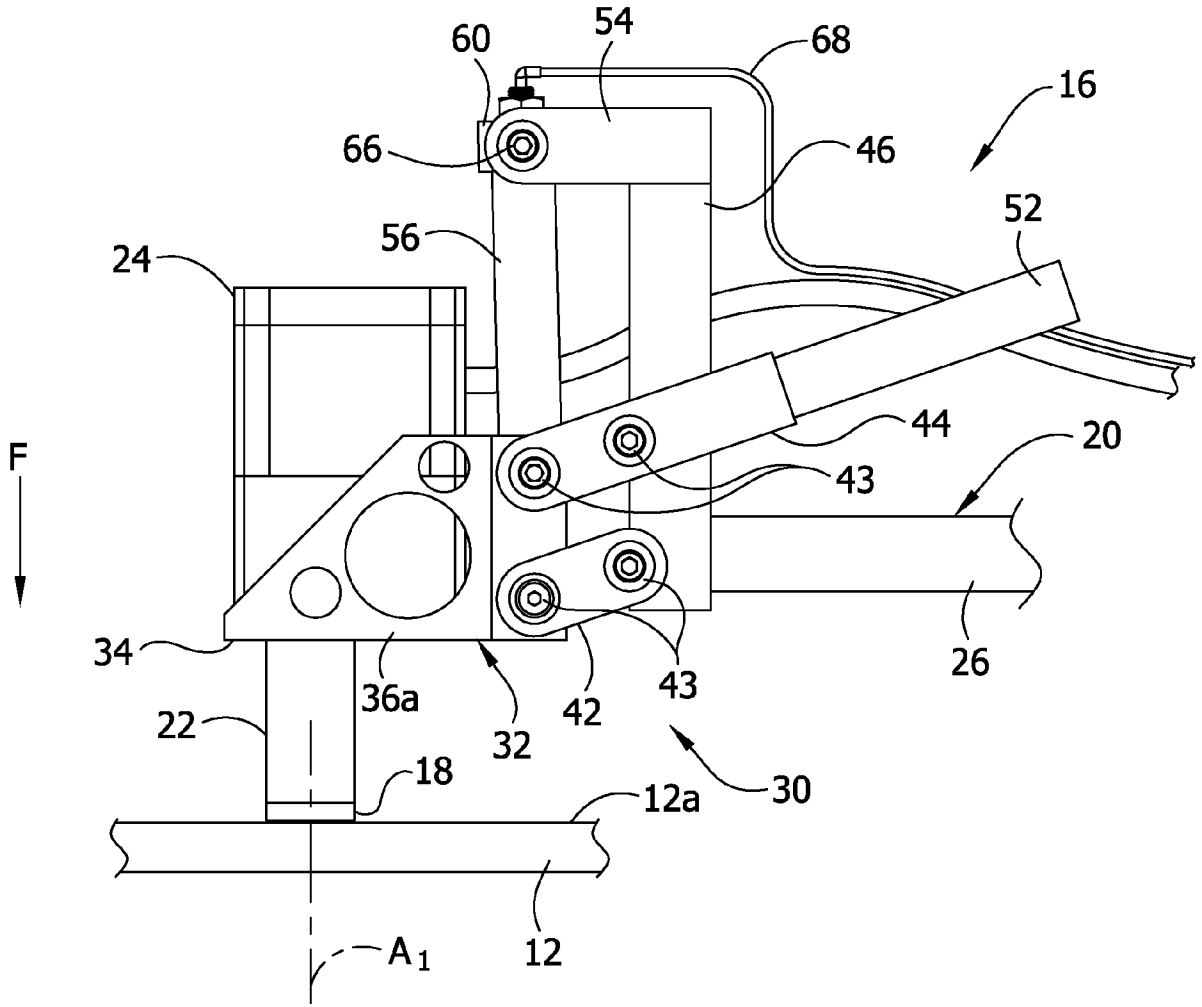
FIG. 3 is a fragmentary side elevational view of the dressing apparatus illustrating cylinders of the dressing apparatus applying a downward force on a motor mount of the dressing apparatus.

Referring now to FIGS. 2 and 3, the dressing apparatus 16 includes a dressing disk 18 (broadly, a dressing member) mounted on a disk mounting system 20. The dressing disk 18 may be diamond impregnated, such as the type manufactured by Kinik Company of Taiwan. In this embodiment, a dressing surface of the disk 18 (i.e., the surface of the disk that contacts the polishing pad) may have a diameter between about 30 mm and about 10 mm, for example, about 20 mm. As will become apparent and also explained in more detail below, a small dressing surface allows for more precise dressing of the polishing pad 12, and the pad thereby produces flatter, smoother and/or more uniform polished wafers.

As explained in detail below, individual components of the disk mounting system 20 rotate the dressing disk 18, move the dressing member radially along the polishing surface of the polishing pad, and exert a selective amount of force on the polishing surface via the dressing disk. The disk mounting system 20 may include additional or alternative components and devices. The dressing disk 18 is secured to an output shaft 22 of a dressing motor 24 (e.g., an electric motor) for rotating the dressing disk about an axis A1 of the output shaft. The axis A1 is generally perpendicular to the polishing surface 12*a* of the polishing pad 12 (FIG. 3) when the dressing apparatus 16 is dressing the pad. Thus, in use the dressing disk 18 rotates about a rotational axis corresponding to the axis A1 of the output shaft 22 that is generally perpendicular to the surface 12*a* of the polishing pad 12.

Figure 10:
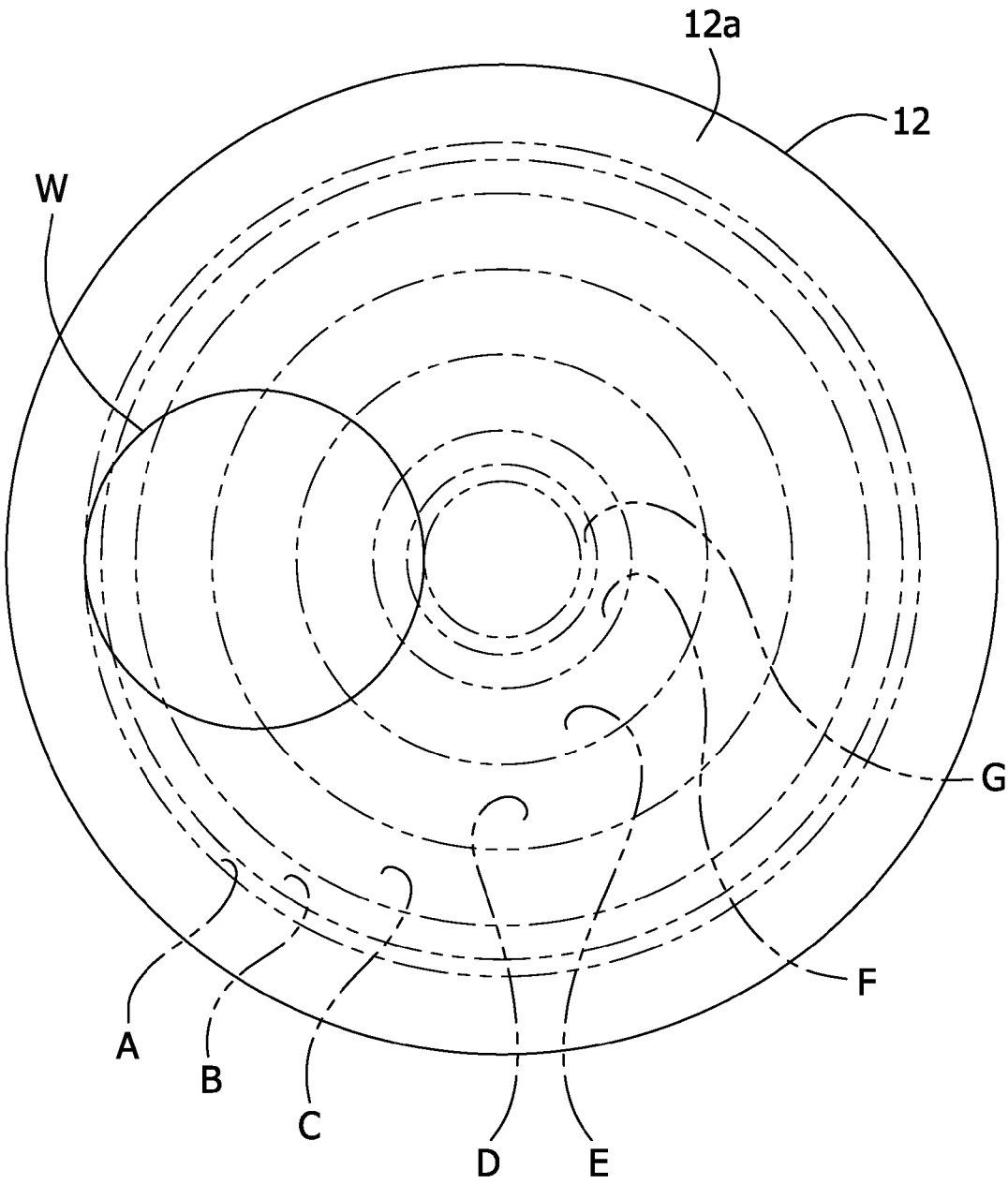
FIG. 10 is a schematic of the polishing pad illustrating radial zones of the polishing surface of the pad.

Referring to FIGS. 2 and 4, the dressing disk 18 and dressing motor 24 are disposed at a first end of an extension arm 26 of the dressing apparatus 16. The extension arm 26 is pivotally connected to an arm motor 28 at its second opposite end 29. The arm motor 28 of this embodiment is adapted to swing the extension arm 26 and the dressing disk 18 over the polishing surface 12*a* of the polishing pad 12 along a generally arcuate path (FIG. 4). The length of the extension arm 26, and the position of the arm motor 28 (i.e., the pivot point of the extension arm) allow the dressing disk 18 to sweep radially across the polishing surface 12*a* from an outer edge of the surface to adjacent its center. As can be seen in FIGS. 4 and 10, only a functional portion of the polishing surface 12*a*, not the entire surface, actually polishes a wafer W. This is because the diameter of the polishing surface (e.g., about 546.1 mm (21.5 in) is more than twice the diameter of the wafer W (e.g., about 200 mm (7.87 in). Thus, only this functional portion of the polishing surface 12*a* needs to be dressed by the dressing apparatus 16. The polishing pad 12 rotates as the dressing disk 18 dresses the polishing surface 12*a*, thereby allowing the dressing apparatus 16 to dress the entire functional portion of the surface.

Figure 5:
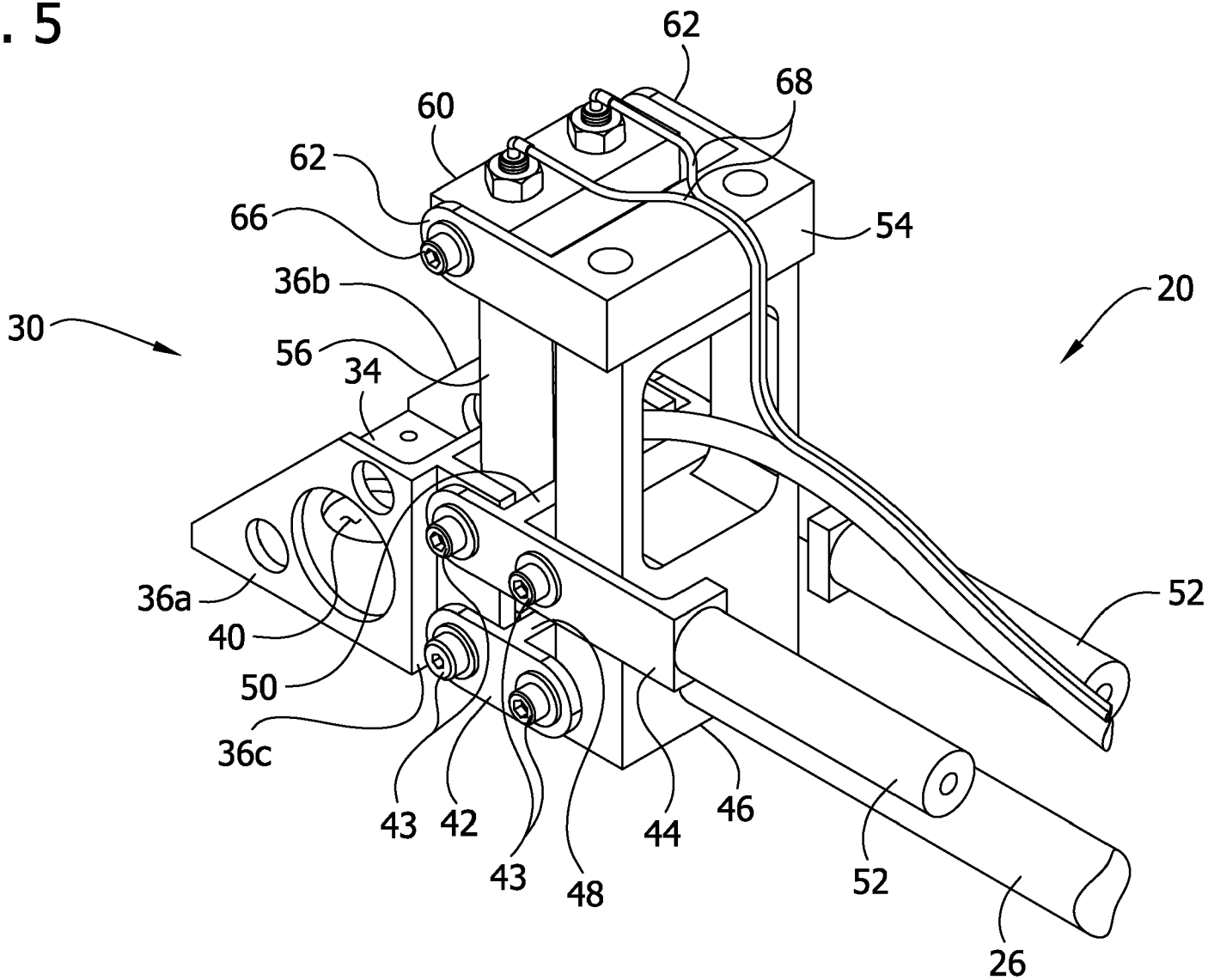
FIG. 5 is a fragmentary perspective of the dressing apparatus with a dressing motor removed for clarity.
Figure 6:
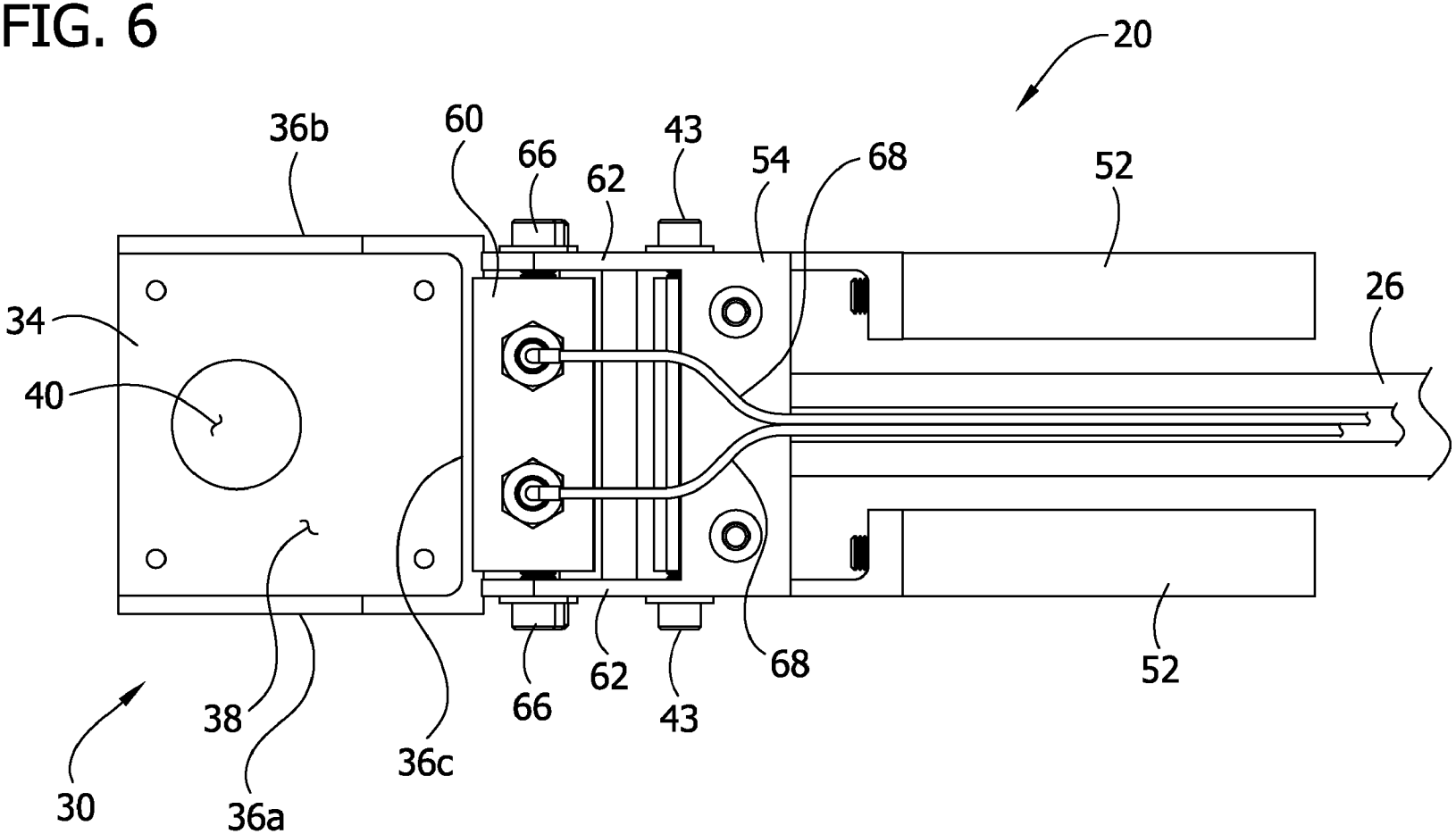
FIG. 6 is a top plan view of the dressing apparatus of FIG. 5.

Referring to FIGS. 3, 5 and 6, the disk mounting system 20 includes a load-applying device 30 that is adapted to apply a selective, generally perpendicular force F (FIG. 3) or load on the polishing surface 12*a* of the polishing pad 12 via the dressing disk 18 as the disk dresses the polishing pad. For example, in the illustrated embodiment, the dressing disk 18 applies a generally vertical, downward force on the polishing surface 12*a* and the polishing surface lies in a plane that is generally horizontal. The load-applying device 30 includes a motor mount 32 secured to the first end of the extension arm 26 for mounting the dressing motor 24 thereon. As shown best in FIGS. 5 and 6, the motor mount 32 includes a platform 34 and opposing side walls 36*a*, 36*b* and a rear wall 36*c* extending upward from the platform defining an enclosure 38 for receiving the dressing motor 24. An opening 40 (FIG. 5, with motor removed) extends through the platform 34 for receiving the shaft 22 of the dressing motor 24.

A pair of lower link members 42 (broadly, lower lever arms) and a pair of upper link members 44 (broadly, upper lever arms) extend rearward from both sides walls 36*a*, 36*b* of the motor mount 32 to a vertical post 46 that is fixedly secured to the free end of the extension arm 26. As shown best in FIG. 5, the lower link members 42 are secured together by a lower crossbar 48, and likewise, the upper link members 44 are secured together by an upper crossbar 50. The lower link members 42 and lower crossbar 48 may be integrally formed, and the upper link members 44 and upper crossbar 50 may be integrally formed. The motor mount 32 is pivotally secured to each of the lower and upper link members 42, 44, respectively, and the lower and upper link members are pivotally secured to the vertical post 46. The motor mount 32 is rotatably secured to the lower and upper link members 42, 44 and the link members are rotatably secured to the vertical post 46 using, for example, fasteners 43. As explained in more detail below, the link members 42, 44 allow the motor mount 32, and more specifically, the platform 34 of the motor mount to remain substantially parallel to the polishing surface 12*a* of the pad 12 as the motor mount moves toward and away from the polishing surface (e.g., up and down). In this way, the dressing disk 18 also remains substantially parallel to the polishing surface 12*a*.

Figure 7:
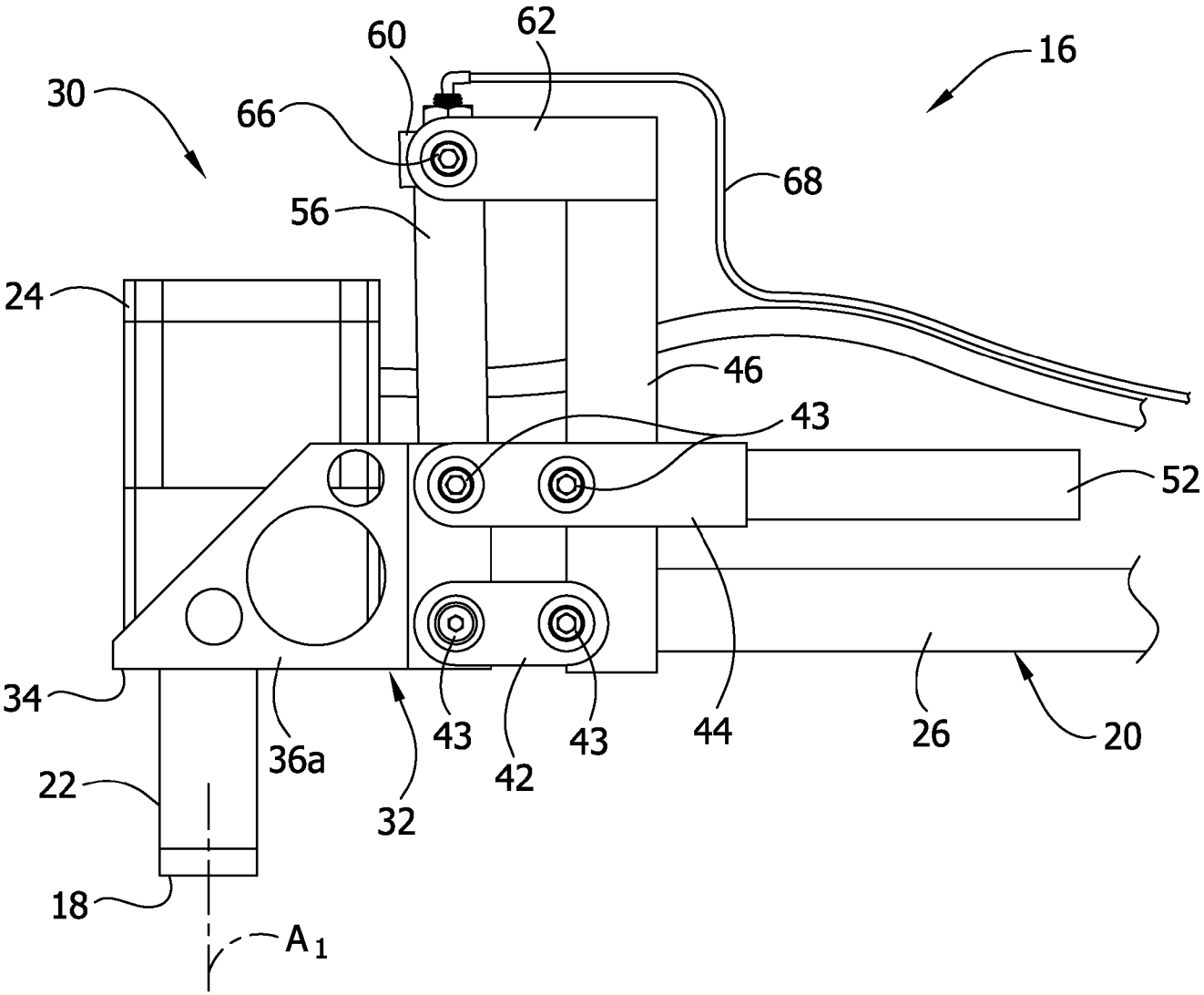
FIG. 7 is a fragmentary side elevational view of the dressing apparatus similar to FIG. 3 but with the cylinders applying zero force on the motor mount.

Rear ends of the upper link members 44 adjacent to the vertical post 46 have counterweights 52 attached thereto for substantially balancing the weight of the motor mount 32, dressing motor 24 and dressing disk 18. As shown in FIG. 7, with no other force acting on the motor mount 32 except for gravity, the motor mount will be in a substantially horizontal position, whereby the link members 44, 42 are generally horizontal and parallel to the extension arm 26 and the polishing surface 12*a* of the pad 12. Accordingly, the load-applying device 30 is constructed so that any force applied to the motor mount 32 is the sole force, and thus the net force, applied to the polishing surface 12*a* via the dressing disk 18.

Figure 9:
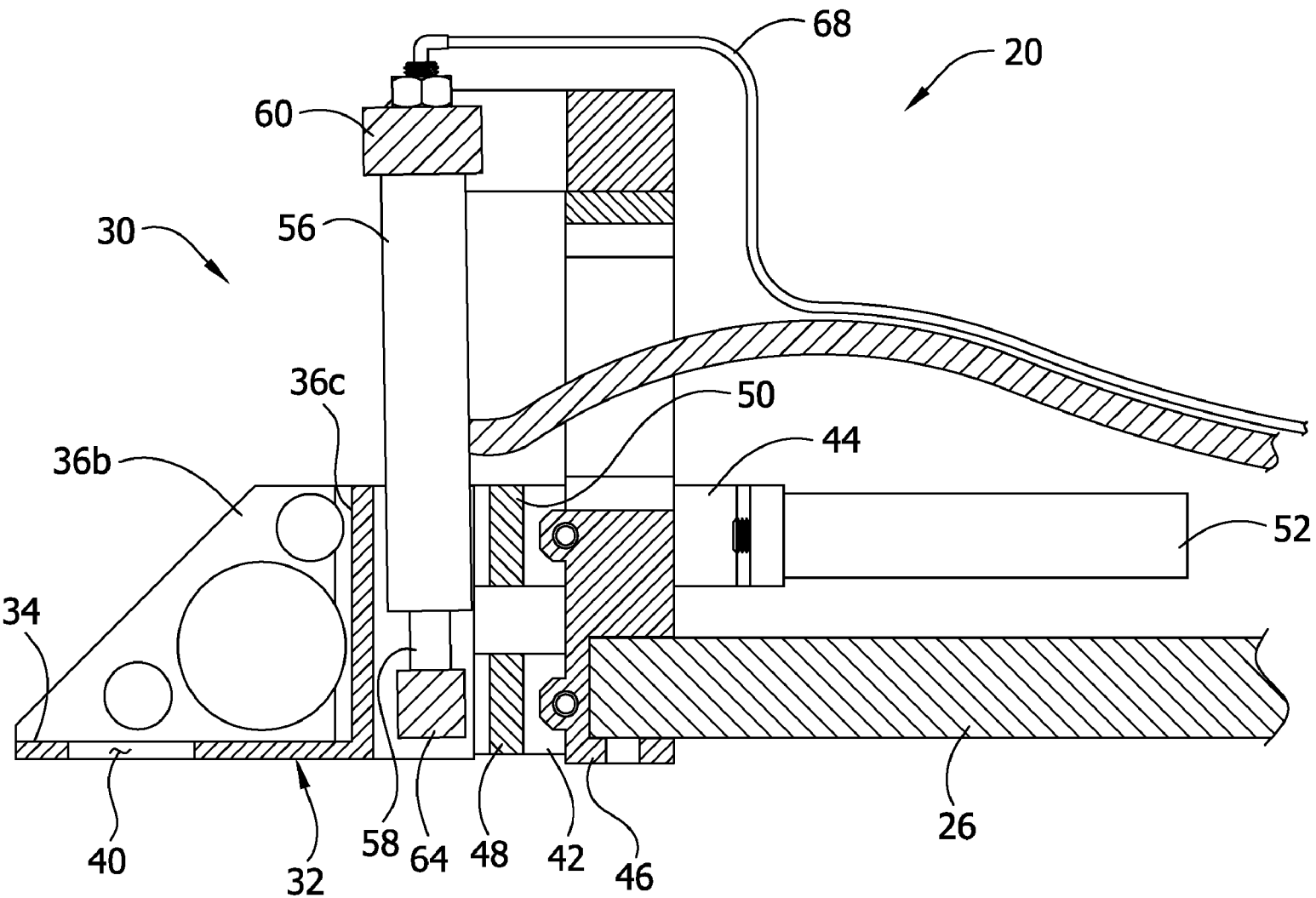
FIG. 9 is a longitudinal section view of the dressing apparatus of FIG. 7.

Referring to FIGS. 3, 5, 6 and 9, a generally U-shaped bracket member extends outward from an upper portion of the vertical post 46 away from the extension arm 26 and toward the motor mount 32. A pair of side-by-side pneumatic cylinders 56 for moving the motor mount 32 up and down have upper ends pivotally secured to the U-shaped bracket 54 extending downward therefrom, and have free ends of their pistons 58 pivotally secured to the motor mount 32. The upper portions of the cylinders 56 are fixedly secured within a sleeve 60, which is received between and rotatably secured to arms 62 of the U-shaped bracket 54 to allow the cylinders 56 to rotate with respect to the bracket. Referring to FIG. 9, the free ends of the pistons 58 of the cylinders 56 are fixedly secured within a cradle 64, which is rotatably secured to the motor mount 32 to allow the pistons to pivot about the motor mount. The sleeve 60 and the cradle 64 may be respectively secured to the arms 62 of the U-shaped bracket 54 and to the cradle 64 by fasteners 66.

The pneumatic cylinders 56 are fluidly connected to a source of compressed air (not shown) via inlet tubing 68 and an inlet valve (not shown). Pressure within the cylinders 56 may be released to atmosphere via bleed valves (not shown). Because the counterweights 52 substantially cancel out any force due to the weight of the motor mount 32, dressing motor 24 and dressing disk 18, air pressure within the cylinders 56 and the amount of force applied to the motor mount by the cylinders correlates directly to the amount of force F applied to the polishing surface 12*a* of the polishing pad 12 via the dressing disk. The cylinders 56 may be other than pneumatic, such as hydraulic, within the scope of the invention.

As mentioned above, the link members 42, 44 allow the platform 34 of the motor mount 32 to remain substantially horizontal and parallel to the polishing surface 12*a* of the polishing pad 12 such that the dressing disk 18 remains generally horizontal and parallel to the polishing surface of the polishing pad. As illustrated in FIG. 7, when the cylinders 56 are not applying a force on the motor mount 32, the motor mount and the link members 42, 44 are generally horizontal and parallel to the polishing surface 12*a* of the pad 12. As shown in FIG. 3, when the pistons 58 are extended and exerting a downward force on the motor mount 32, the upper and lower link members 42, 44 rotate downward relative to the vertical post 46 about the corresponding fasteners 43. At the same time, the motor mount 32 rotates upward relative to the link members 42, 44 about the corresponding fasteners 42. Moreover, the sleeve 60 and thus the upper portions of the pneumatic cylinders 56 rotate away from the motor mount 32 about the fasteners 66 while the cradle 64 and thus the free ends of the pistons 58 rotate about the corresponding fasteners. Thus, through this arrangement, the motor mount 32 remains substantially parallel to the polishing surface 12*a* of the polishing pad 12 (e.g., substantially horizontal) so that the dressing disk 18 remains in flush contact with the polishing surface of the polishing pad as the motor mount moves up and down.

Figure 8:
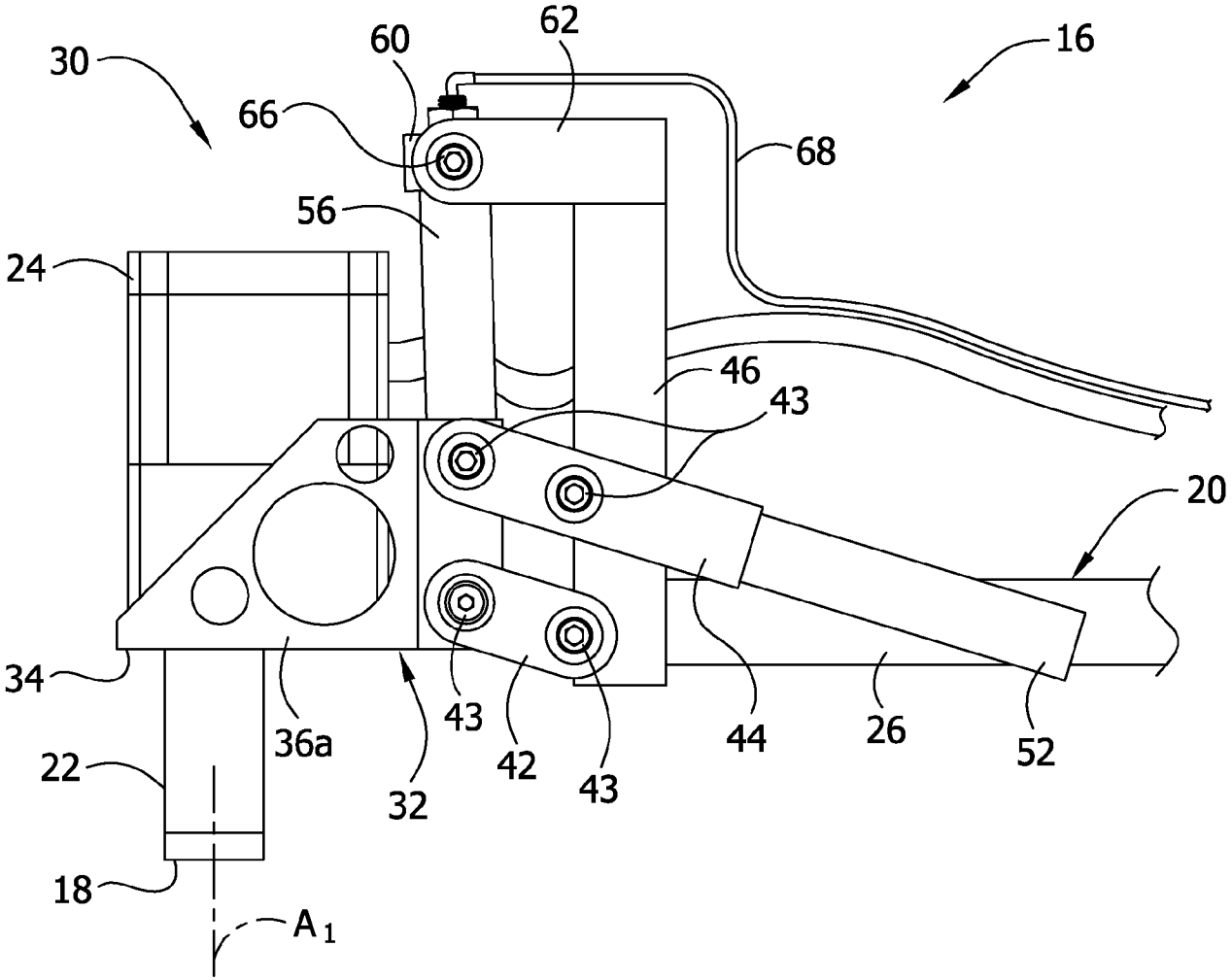
FIG. 8 is a fragmentary side elevational view of the dressing apparatus similar to FIG. 3 but with the cylinders applying an upward force on the motor mount to raise the mount to an elevated position.

As illustrated in FIG. 8, the dressing apparatus 16 may be constructed such that when the pistons 58 of the cylinders 56 are fully retracted and applying an upward force on the motor mount 32, the upper and lower link members 42, 44 rotate upward about the corresponding fasteners 43; the motor mount 32 rotates downward about the corresponding fasteners; and the sleeve 60 and the cradle 64, and thus the cylinders 56, rotate toward the motor mount about the corresponding fasteners 66. In this way, the motor mount 32 may be elevated above its horizontal position so as to preclude contact between the dressing disk 18 and the polishing pad 12 while the extension arm 26 swings the dressing disk back to its original position after completion of the dressing process.

Figure 11:
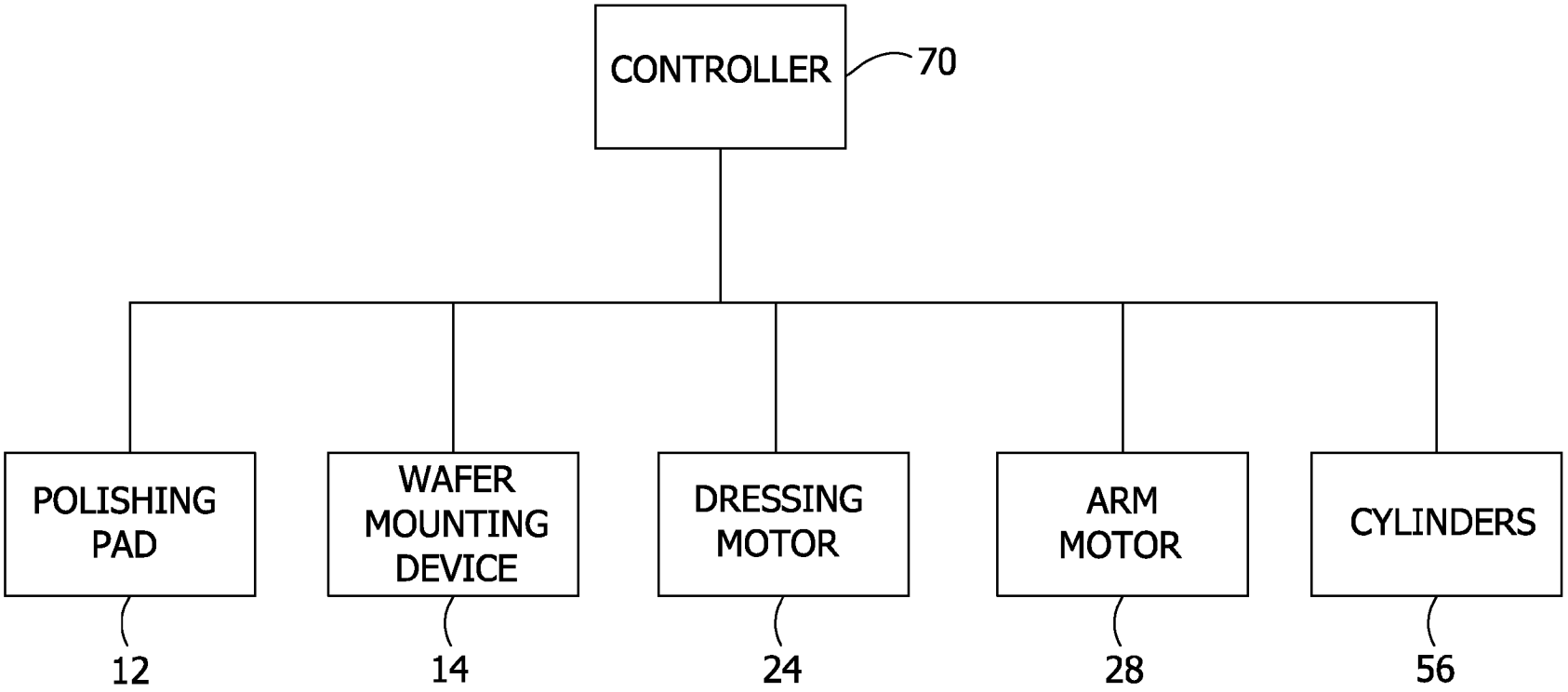
FIG. 11 is a schematic of an integrated system including a controller and the wafer polishing system.

In one embodiment, a controller 70 (FIG. 11), such as a microcontroller, controls the pneumatic cylinders 56 to dress the polishing pad 12. As illustrated schematically in FIG. 11, the controller 70 may also control the polishing pad 12 (more specifically the rotatable base of the polishing pad), the wafer mounting device 14 (more specifically the rotatable head of the mounting device), the dressing motor 24 and the arm motor 28, so that the entire wafer polishing system 10 is integrated. As explained in more detail below, the microcontroller 70 dresses individual radial zones of the functional portion of the polishing surface 12*a* according to a set of pre-programmed instructions or a preprogrammed "dressing recipe". That is, the microcontroller 70 adjusts the amount of force exerted on individual radial zones of the polishing pad by the dressing disk according to the instructions given in a pre-programmed recipe. In one example, a feedback circuit is used, and the controller 70 controls the inlet and bleed valves, which may be solenoid valves, to adjust the pressures in the cylinders 56 according to the recipe. Thus, the controller 70 adjusts the pressures in the cylinders 56 when the dressing disk 18 is moving radially along the polishing surface 12*a* to increase or decrease the force applied to the polishing surface.

The cylinders 56 are also capable of exerting a constant force F on the polishing surface 12*a* of the polishing pad 12 as it dresses the pad radially. Accordingly, when the dressing disk 18 encounters a low spot or a high spot in a radial portion of the polishing surface 12*a*, the cylinders 56 may have to increase or decrease the pressure in the cylinders to maintain constant pressure in the cylinders. Otherwise, if the dressing disk 18 and therefore the motor mount 32 moved upward, for example, when encountering a high spot, the pistons 58 of the cylinders 56 would also be forced upward, and if the cylinders did not allow for adjustment of air pressure, then the air pressure within the cylinders would increase, resulting in an increase in the force exerted by the pistons and in an increase in the force F exerted on the polishing surface 12*a* at the high spot. In one example, a feedback circuit is used, and the controller 70 controls the inlet and bleed valves of the cylinders 56 to adjust the pressures in the cylinders according to the change in pressures due to high and low spots on the polishing surface 12*a*.

Because it is typically advantageous to change the force F exerted by the dressing disk 18 along the radius of the polishing surface 12*a* and because the dressing apparatus 16 moves up and down along the contours of each radial portion of the polishing surface, the pneumatic cylinders 56 preferably have very low hysteresis. Such cylinders 56 having very low hysteresis are typically referred to as "hysteresis-free cylinders", although the actual hysteresis may be between about 5% and about −5% of the load to be applied. The hysteresis-free cylinders may be constructed of a graphite cylinder that slides smoothly, without lubrication, within a Pyrex glass cylinder. Through this construction, the cylinder has very low stiction at the beginning of a stroke, resulting in very low hysteresis. The hysteresis-free cylinders 56 allow for the controller 70 to precisely change the force F exerted on the polishing surface 12*a* by the dressing disk 18 because the correlation between the pressure within the air cylinders and the force exerted on the polishing surface will remain constant regardless of whether the piston is extending or retracting. Without hysteresis-free cylinders 56, the amount of pressure within the cylinders may not directly correlate to the amount of pressure exerted on the polishing pad 12 by the dressing disk 18. The same holds true for changing the air pressure in the cylinders 56 to maintain a constant force F. Without hysteresis-free cylinders 56, the pressure in the cylinders may not directly correlate to the amount of force F exerted by the cylinders 56.

Referring to FIG. 10, in one embodiment the microcontroller 70 adjusts the amount of force exerted on individual radial zones A, B, C, D, E, F and G of the polishing surface 12*a* according to a selected pre-programmed dressing recipe. In one example, the dressing recipes are based on the shape of the polished surface of at least one sampled polished wafer produced by the polishing system 10. More specifically, the average radial two-dimensional profiles of the wafers are used. It is understood that the shape of the polished surface of the wafer may be generalized or characterized in other ways besides analyzing its average radial two-dimensional profile. For example, a three-dimensional profile may be used.

The dressing recipes may be formulated through empirical data. For example, the average two-dimensional radial profiles of the polished surfaces of numerous polished wafers may be analyzed so that wafers having like shapes of their polished surfaces can be categorized into a shape category. The optimal dressing process for wafers in each category (i.e., the optimal amount of force F to apply in each radial zone of the polishing surface 12*a*) may be determined empirically. Thus, tests may be performed to determine the optimal amount of force F to apply in each radial zone for each developed category.

In use, a wafer measuring device (not shown), such as an ADE UltraGage 9700, measures the thickness of a sampled polished wafer. The thickness of the polished wafer is integrated through 360 degrees to obtain an average radial two-dimensional profile of the sampled wafer. The sampling rate for obtaining the average radial profile of a previously polished wafer may be about 1 wafer in every 25 wafers polished. It is understood that a greater number of wafers may be polished between samplings, or alternatively, each polished wafer may be sampled to determine its polished surface profile. Moreover, the sampling rate may change during the life of the polishing pad.

The radial profile of the sampled wafer may be categorized by an operator, for example, into one of the categories. Based on the category in which the sampled wafer falls, the operator selects an appropriate preprogrammed recipe associated with the selected category, which is input to a microcontroller 70. For example, a specific preprogrammed dressing recipe may be used for dressing the polishing pad when the polishing pad produced a sampled wafer having a polished surface with a concave average radial two-dimensional profile, and a different preprogrammed dressing recipe may be used for dressing the polishing pad when the polishing pad produced a sampled wafer having polished surface with a convex average radial two-dimensional profile. The selected recipe instructs the microcontroller 70 to apply a selected amount of force to each radial zone of the polishing pad. It is understood that the number of radial zones may vary, depending on the desired precision of the dressing process. The microcontroller 70 controls the pneumatic cylinders, more particularly, the amount of pressure in the cylinders, to adjust the force exerted on the polishing pad according to the selected recipe. It is contemplated that the entire process may be automated, whereby the microcontroller 70 measures a polished wafer, analyzes the radial profile of the sampled polished wafer and chooses the appropriate dressing recipe based on the radial profile of the sampled polished wafer.

Using this process, the polished wafer, not the polishing surface 12*a* of the polishing pad 12, is analyzed to determine an appropriate dressing process for the polishing pad. In general, it is believed that deriving a dressing process based on the sampled polished wafer is easier and more efficient than deriving a dressing process based on the polishing surface 12*a* of the polishing pad 12. However, the radial profile of a polished wafer can be readily and accurately measured, and the radial profile may be analyzed to also readily determine not only which areas of the polishing pad need to be dressed, but also to what extent specific areas need to be dressed.

As can be seen from the below exemplary dressing recipes, in general a larger force F is applied to the zones of the polishing surface 12*a* corresponding to portions of the wafer that are thinner than the average thickness of the wafer get. Likewise, a smaller force F is applied to the zones of the polishing surface 12*a* that polish portions of the wafer which are thicker than the average thickness of the wafer. In general, a zone of the polishing surface 12*a* having a greater thickness than other zones of the polishing pad will thin out the corresponding wafer location more than other zones of the polishing pad. Thus, the polishing surface zones having a greater thickness need more force applied to them to thin them out, and relatedly, polishing pad zones having a lesser thickness need less force applied to them. Dressing the different zones of the polishing surface 12*a* based on the radial profiles of polished wafers is an accurate way of producing polished wafers with substantially uniform thicknesses.

EXEMPLARY RECIPES

The following are examples of dressing recipes for three categories of polishing pads using the above-described illustrated embodiment of the dressing system with a 20 mm diameter dressing disk. For purposes of the following examples, the functional portion of the polishing pad (i.e., the portion of the pad that dresses the wafer) is categorized into seven radial zones A, B, C, D, E, F and G as depicted in FIG. 10. For purposes of the below examples, the functional portion is characterized as a one-dimensional coordinate system spanning from the outer periphery of the portion to the inner periphery portion. Thus, the outer periphery of the functional portion has a coordinate of 0 mm and the inner periphery has a coordinate of 200 mm. Radial zone A extends from 0 mm to 10 mm. Radial zone B extends from 10 mm to 30 mm. Radial zone C extends from 30 mm to 75 mm. Radial zone D extends from 75 mm to 125 mm. Radial zone E extends from 125 mm to 170 mm. Radial zone F extends from 170 mm to 190 mm. Radial zone G extends from 190 mm to 200 mm.

An optimal force applied to each zone of the polishing pad was determined through empirical studies. It is understood that the loads may be other than given without departing from the scope of this invention. It is also understood that there may be numerous other recipes for the dressing apparatus, in addition to or in place of the exemplary recipes.

Example 1

Dished-shaped Wafer

Figure 12:
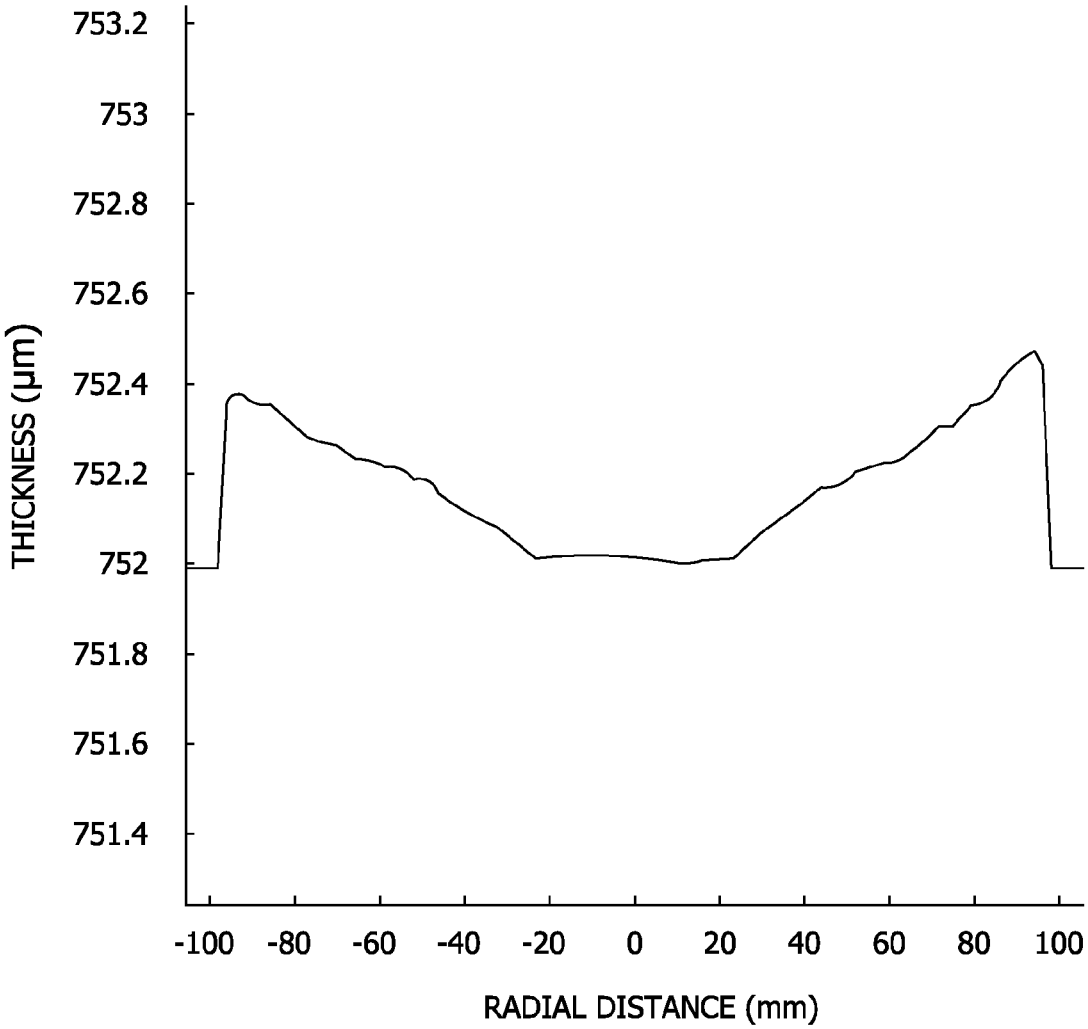
FIG. 12 is a graphical representation of a two-dimensional radial profile of a wafer have a dish-shaped polished surface.

A recipe is given for dressing a polishing pad that produced dished-shaped wafer. A radial profile of a dished wafer is illustrated in FIG. 12. In general, a dished wafer has a greater thickness adjacent its periphery and gradually decreases in thickness radially towards its center. Thus, the polished surface of the wafer is generally concave.

The following table is an exemplary recipe for a polishing pad producing dished wafers:

| Radial Zone | Load Applied (N) |
|---|---|
| A | 0.067 |
| B | 0.067 |
| C | 0.500 |
| D | 1.000 |
| E | 0.500 |
| F | 0.067 |
| G | 0.067 |

Example 2

Dome-Shaped Wafer

Figure 13:
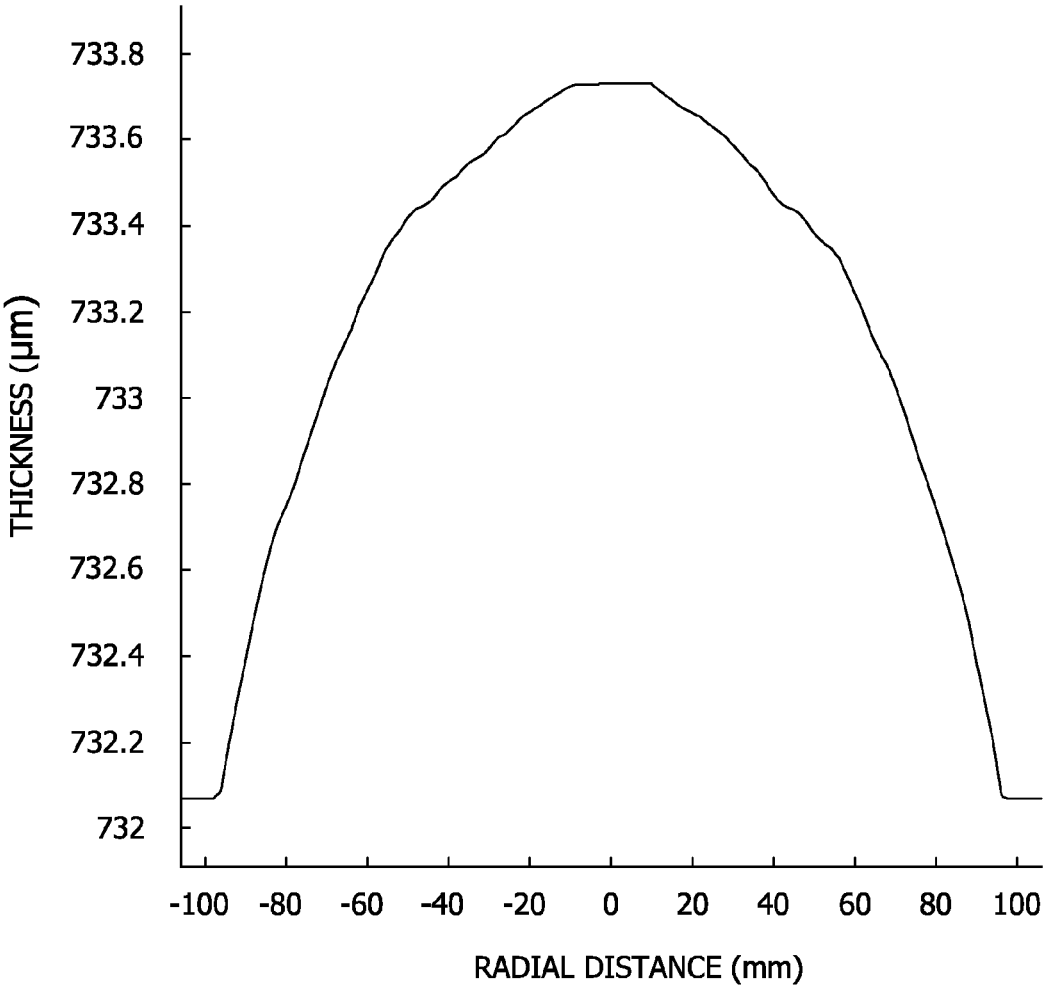
FIG. 13 is a graphical representation of a two-dimensional radial profile of a wafer have a dome-shaped polished surface.

A recipe is given for dressing a polishing pad that produced a dome-shaped wafer. A radial profile of a domed-shaped wafer is illustrated in FIG. 13. In general, a dome-shaped wafer has a lesser thickness adjacent its periphery and gradually increases in thickness radially towards its center. Thus, the polished surface of the wafer is generally convex.

The following table is an exemplary recipe for a polishing pad producing dished wafers:

| Radial Zone | Load Applied (N) |
|---|---|
| A | 1.000 |
| B | 0.834 |
| C | 0.500 |
| D | 0.067 |
| E | 0.500 |
| F | 0.834 |
| G | 1.000 |

Example 3

Double-Hump Wafer

Figure 14:
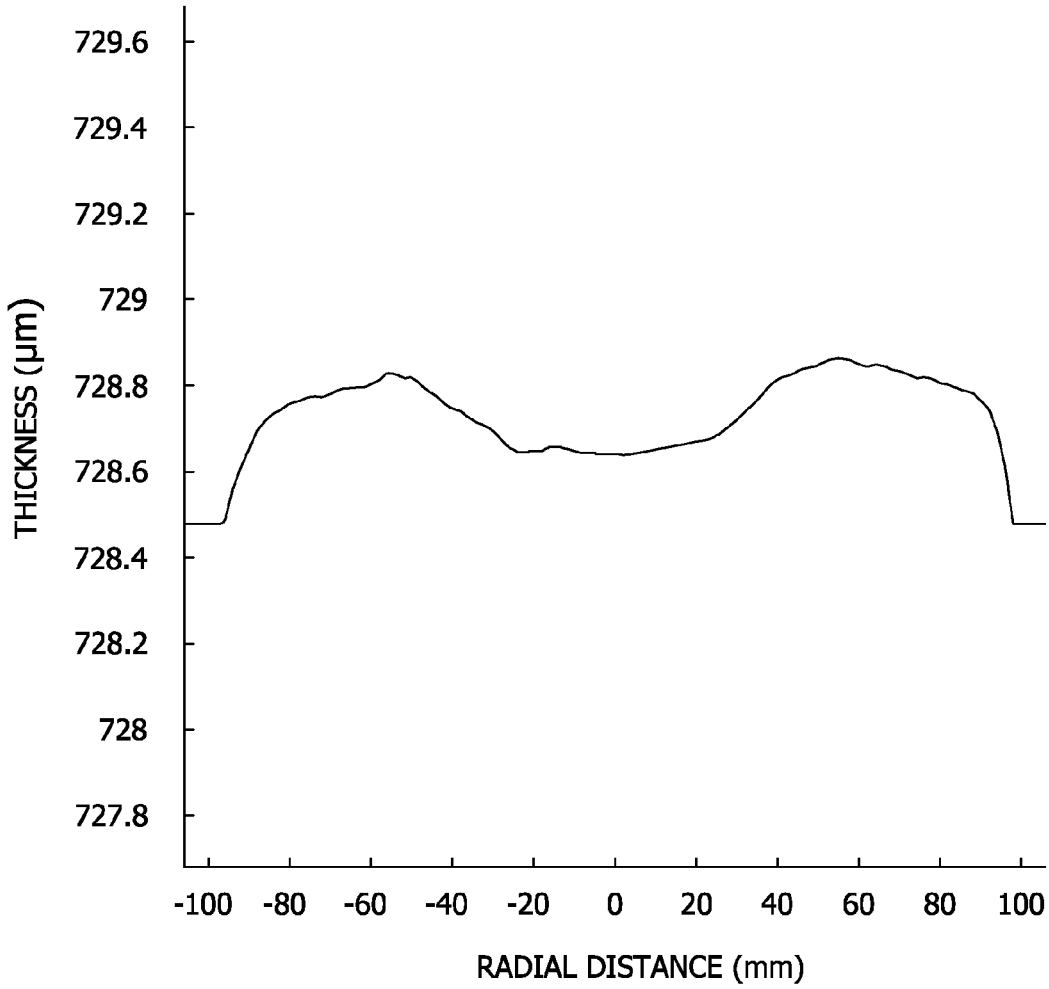
FIG. 14 is a graphical representation of a two-dimensional radial profile of a wafer have a double-hump-shaped polished surface Corresponding reference characters indicate corresponding parts throughout the drawings.

A recipe is given for dressing a polishing pad that produced a double-hump wafer. A radial profile of a double-hump wafer is illustrated in FIG. 14. In general, a double-hump wafer has a lesser thickness adjacent its periphery, gradually increases in thickness radially towards its center, and then gradually decreases in thickness adjacent its center. Thus, the polished surface of the wafer has two humps between its center and its periphery.

The following table is an exemplary recipe for a polishing pad producing double-hump wafers:

| Radial Zone | Load Applied (N) |
|---|---|
| A | 0.800 |
| B | 0.080 |
| C | 0.400 |
| D | 1.000 |
| E | 0.400 |
| F | 0.080 |
| G | 0.800 |

It is understood that other recipes for other polishing pads that produced profile shapes other than described are within the scope of the present invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A method of dressing a polishing surface of a polishing pad used in polishing of wafers, the method comprising:

obtaining a radial profile of a wafer polished with the polishing pad, categorizing the polished wafer into one of a plurality of profile categories based on the radial profile of the wafer, selecting a recipe, from a plurality of recipes, corresponding to the profile category in which the polished wafer was categorized, wherein each of the plurality of recipes corresponds to one of the plurality of profile categories, dressing the polishing surface of the pad according to the selected recipe using a dressing apparatus.

2. The method of claim 1 wherein the recipe is a pre-programmed set of instructions for a microcontroller, and whereby the microcontroller dresses the pad according to the recipe using the dressing apparatus.

3. The method of claim 2 wherein said categorizing includes manual analysis of the radial profile of the wafer and wherein said selecting includes manual selection of the recipe for the microcontroller.

4. The method of claim 2 wherein said categorizing includes automatic analysis of the radial profile of the wafer by the microcontroller and wherein said selecting includes automatic selection of the recipe by the microcontroller based on its analysis of the radial profile.

5. The method of claim 2 wherein said pre-programmed set of instructions instructs the microcontroller to adjust an amount of force exerted by the dressing apparatus on individual radial zones of the polishing pad during dressing of the polishing pad.

6. A method of dressing a polishing surface of a polishing pad used in polishing of wafers, the method comprising:

obtaining an average radial two-dimensional profile of a wafer polished with the polishing pad, categorizing the polished wafer into one of a plurality of profile categories based on the average radial two-dimensional profile of the wafer, selecting a recipe, from a plurality of recipes, corresponding to the category in which the polished wafer was categorized, wherein each of the plurality of recipes corresponds to one of the plurality of profile categories, and dressing the polishing surface of the pad according to the selected recipe using a dressing apparatus.

7. The method of claim 6 wherein the recipe is a pre-programmed set of instructions for a microcontroller, and whereby the microcontroller dresses the pad according to the recipe using the dressing apparatus.

8. The method of claim 7 wherein said categorizing includes automatic analysis of the radial profile of the wafer by the microcontroller and wherein said selecting includes automatic selection of the recipe by the microcontroller based on its analysis of the radial profile.

9. The method of claim 7 wherein said pre-programmed set of instructions instructs the microcontroller to adjust an amount of force exerted by the dressing apparatus on individual radial zones of the polishing pad during dressing of the polishing pad.

10. A method of dressing a polishing surface of a polishing pad used in polishing of wafers, the method comprising:

obtaining a radial profile of a wafer polished with the polishing pad, categorizing the polished wafer into a profile category based on the radial profile of the wafer, selecting a recipe corresponding to the selected category, wherein the recipe is a pre-programmed set of instructions for a microcontroller of a dressing apparatus, and wherein said recipe instructs the microcontroller to adjust an amount of force to be exerted by the dressing apparatus on individual radial zones of the polishing pad, and dressing the polishing surface of the pad according to the selected recipe using the dressing apparatus.

11. The method of claim 10 wherein said categorizing includes manual analysis of the radial profile of the wafer and wherein said selecting includes manual selection of the recipe for the microcontroller.

12. The method of claim 10 wherein said categorizing includes automatic analysis of the radial profile of the wafer by the microcontroller and wherein said selecting includes automatic selection of the recipe by the microcontroller based on its analysis of the radial profile.

* * * * *